US012031350B2

(12) United States Patent
Pandolfo et al.

(10) Patent No.: US 12,031,350 B2
(45) Date of Patent: Jul. 9, 2024

(54) SWIMMING POOL ALIGNMENT

(71) Applicant: MP Hydro Pty Limited, Cooks Hill (AU)

(72) Inventors: Jason Pandolfo, Griffith (AU); Anthony Mark Cross, Cooks Hill (AU)

(73) Assignee: MP HYDRO PTY LIMITED, Cooks Hill (AU)

( * ) Notice: Subject to any disclaimer, the term of this patent is extended or adjusted under 35 U.S.C. 154(b) by 0 days.

(21) Appl. No.: 17/893,595

(22) Filed: Aug. 23, 2022

(65) Prior Publication Data

US 2023/0068642 A1 Mar. 2, 2023

(30) Foreign Application Priority Data

Aug. 24, 2021 (AU) ..... 2021221535

(51) Int. Cl.
*E04H 4/00* (2006.01)

(52) U.S. Cl.
CPC ... *E04H 4/0037* (2013.01); *E04H 2004/0068* (2013.01)

(58) Field of Classification Search
CPC ..... E04H 4/0037; E04H 2004/0068
USPC ..... 4/506
See application file for complete search history.

(56) References Cited

U.S. PATENT DOCUMENTS

| | | | | |
|---|---|---|---|---|
| 3,409,916 | A * | 11/1968 | Billig | E04H 4/0018 52/249 |
| 3,930,346 | A | 1/1976 | Blakeway | |
| 5,277,004 | A * | 1/1994 | Frei | E04H 4/0087 4/506 |
| 5,791,099 | A | 8/1998 | Duffy | |
| 6,571,404 | B2 * | 6/2003 | Hall | E04H 4/0043 4/506 |
| 2014/0157509 | A1 | 6/2014 | Lan | |
| 2015/0089732 | A1 | 4/2015 | Khamis et al. | |
| 2021/0131131 | A1 | 5/2021 | Meyer | |

FOREIGN PATENT DOCUMENTS

| | | | |
|---|---|---|---|
| AU | 2019203161 | B2 | 5/2020 |
| ES | 1014115 | U | 2/1991 |

OTHER PUBLICATIONS

Examination Report No. 1 dated Mar. 11, 2022 for corresponding Australian Application No. 2021221535, filed Aug. 24, 2021.

* cited by examiner

*Primary Examiner* — Huyen D Le
(74) *Attorney, Agent, or Firm* — David D. Brush; Westman, Champlin & Koehler, P.A.

(57) ABSTRACT

A pool unit including a pool shell, which has a wall, and a bracing structure bracing the wall to curve inwardly. The pool shell is fillable with water to straighten the wall to form a straight wall.

15 Claims, 1 Drawing Sheet

SWIMMING POOL ALIGNMENT

FIELD OF THE INVENTION

The invention relates to swimming pools.

BACKGROUND TO THE INVENTION

A swimming pool is a vessel for holding a volume of water sufficient for swimming.

Some swimming pools are formed of concrete applied in liquid form (with suitable reinforcement, etc) and allowed to set in situ. Various surface finishes such as tiles are applied to provide the pool with an attractive interior.

Another mode of construction entails a freely pliable impermeable liner supported by a steel frame. This mode of construction is relatively inexpensive although the end result is less attractive. The pliable liner billows out between the frame members and generally appears to be flimsy.

Another approach entails the installation of a pool shell. A pool shell is a semi-rigid liner that when properly installed can be just as attractive as a concrete pool.

Pool shells are typically formed of fiber-reinforced polymer known as fiberglass by applying layers of material to a male mold. Typically, the first layer is a gel coating that has an attractive appearance when the shell is pulled from the mold. The fiberglass is often in the vicinity of 5.5 mm thick. The initial applicant's pool shells are often in the range of 6 mm to 10 mm thick. In the context of a pool shell, 10 mm thick fiberglass is relatively flexible. As such, pool shells must be carefully installed to produce a pool that is attractive and robust.

Pool shells are frequently installed "in ground". This entails manipulating bulk material by digging a hole that is larger than the shell, placing the shell and then carefully backfilling thereabouts. As such, the earth and/or any groundwater supports the pool shell against the hydrostatic pressure of the water within the pool.

In recent years, the initial applicant has developed above-grounds swimming pools comprising pool shells braced by support structures as described in Australian patent no. 2019203161. The B2 publication of that patent is incorporated herein by reference. Whilst these externally braced pools are advantageous departures from convention, the present inventors have recognised room for further improvement.

The present invention aims to provide improvements in and for swimming pools or at least to provide an alternative for those concerned with swimming pools.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a pool unit comprising a pool shell comprising a wall; and bracing structure bracing the wall to curve inwardly;

wherein the pool shell is fillable with water to straighten the wall to form a straight wall.

The bracing structure may comprise upright supports to act in compression between a rim of the pool shell and an underlying support surface.

Preferably, each upright support comprises an upright strut portion; and an upright plate portion connecting the upright strut portion to the pool shell.

A height of the upright plate is preferably at least one quarter, or more preferably at least one third, of a height of the upright support.

Another aspect of the invention provides a method, of forming a pool unit, comprising bracing a wall of a pool shell to curve inwardly;

wherein the pool shell is fillable with water to straighten the wall to form a straight wall.

Preferably, the pool shell is seated on a planar support surface.

The method may comprise loading a loading system to curve the wall then bracing the wall with bracing structure.

The method may comprises unloading the loading system to load the bracing structure. Preferably, the method comprises unloading the loading system to load the bracing structure, then checking a straightness of the wall. Most preferably, the method comprises unloading the loading system to load the bracing structure; then at least partly filling the pool shell; then checking a straightness of the wall.

The method may comprise adjusting the bracing of the wall in response to the checking.

DESCRIPTION OF EMBODIMENTS

The present inventors have recognised that a pool shell can deform and curve outwardly when filled with water. In particular, straight walls of the pool can be outwardly deformed so that they are unsightly. In preferred implementations of the invention, a wall of the pool shell is braced to an inward curvature in anticipation of the outward deformation that will come when the pool is filled with water so as to produce a more attractive end product.

Figure 1:
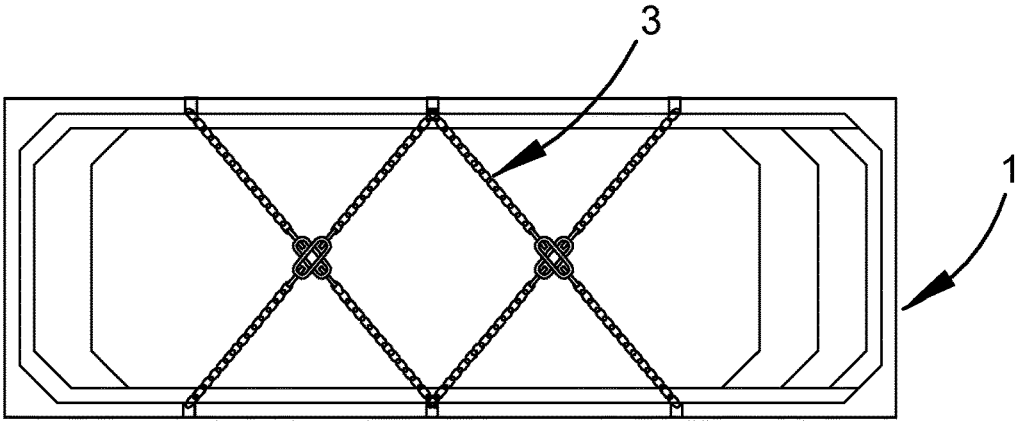
FIG. 1 is a plan view of a pool shell.
Figure 2:
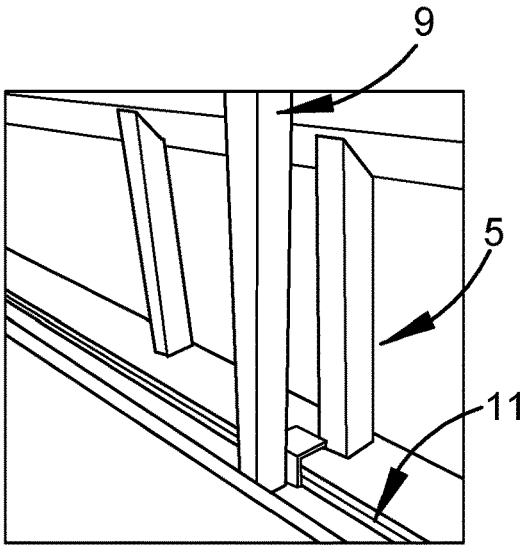
FIG. 2 is a perspective view of a lower end of an upright.

The wall to be curved may be one or two walls to be curved. FIG. 1 is a plan view of a rectangular pool shell 1 fitted with a loading system 3 by which the opposed long walls are loadable.

This example of the loading system 3 comprises four tensionable elements made up of two pairs of tensionable elements symmetrically opposed to each other. The tensionable elements of each pair attach at one point on a wall and diverge to respective points of attachment on the other wall. In this way, there are three loading points along each wall. Other implementations are possible. By way of example, there might only be one wall to be curved and it might only be loaded at one point, although preferably each wall to be curved is loaded at two or more points.

In this example, the tensionable elements each comprise a turnbuckle in series with a length of timber, although any convenient pulling system may be used, e.g. ratchet straps may be convenient. Loading systems that push rather than pull on the wall(s) are also possible.

In a preferred implementation of the method, the shell 1 is placed on a support surface which preferably comprises pavement. The support surface is most preferably a concrete test slab, and is preferably both horizontal and planar. Preferably, the support surface is horizontal and planar within tolerances tighter than typical of concreting.

Once on the test slab, the loading system can be applied to curve the two opposed walls. The curvature is preferably checked. Most preferably, this is achieved with a string line. Preferably, the turnbuckles are individually adjusted to produce a defined inward deflection. In the context of the illustrated 6 m pool, the deflection may be about 15 mm. Most preferably, the turnbuckles are also adjusted so as to produce a relatively steady radius along the side wall of the pool. It is also preferred to centralise the maximum point of deflection along the wall.

The target degree of deflection may vary in positive relation to the length of the target wall. By way of example, in the context of a 4 m long version of the 6 m wall described above, a target displacement of 10 mm may be appropriate, whereas if the same wall was extended to 10 m the target displacement may be about 30 mm.

With the walls inwardly loaded, the external bracing can be completed. Separate elements of the bracing structure may be attached at any convenient time, although preferably the support structure is not configured to take load until after the target wall has been loaded and inwardly curved.

In this example, inboard uprights 5 are adhered to the lower reaches of an exterior of the shell 1. The illustrated uprights 5 run from about ground level up to about the step ledge (or other elongate stiffening formation) although there are other options. Portions 5 are preferably plastic, e.g. glass-reinforced plastic (GRP). In this example, they are 76 mm×76 mm tubular section.

Figure 3:
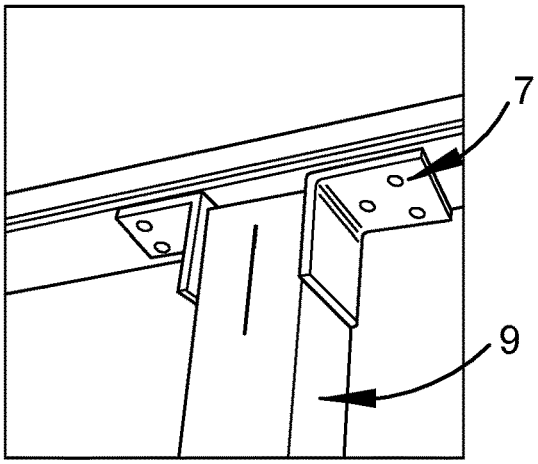
FIG. 3 is an upwards perspective view of the attachment of the upright to coping.
Figure 4:
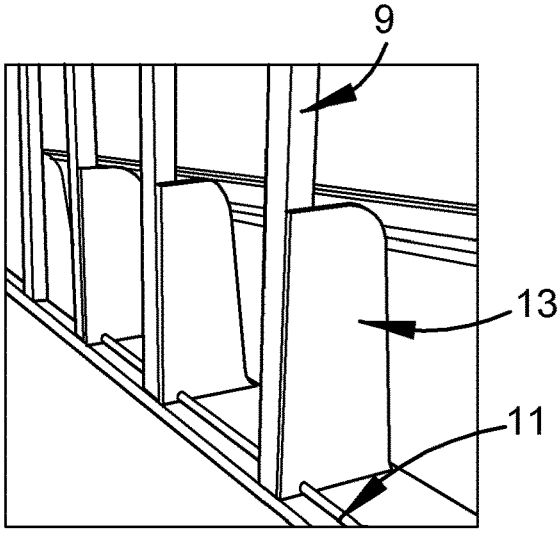
FIG. 4 is a perspective view of bracing structure on a wall of the pool shell.

Mounting brackets 7 in the form of simple L-shaped brackets are fixed to an underside of the rim of the pool. The rim is also known as "coping". In this example, the brackets 7 are adhered and screwed to the underside of the rim. FIG. 3 illustrates a pair of brackets 7. A plurality of such pairs are spaced along the side of the pool. The brackets within each pair are mutually spaced to accommodate the upper end of an upright 9. The uprights are preferably formed of plastic, most preferably of GRP. In this example, they are formed of 76 mm×76 mm tubular section.

In this example, the uprights 9 are vertical and extend downwardly to sit in a channel 11, sitting on the support surface and running along the side wall of the pool. The channel 11 is an example of connecting structure mutually connecting lower portions of the uprights 9. There are other options.

Reinforcing webs 13 are then attached to both the upright 9 and the lower upright 5. The plate may be attached with adhesives and/or screws. In this example, the plate runs from ground level up to the step ledge, thereby vertically spanning about half of a height of the pool shell. With the plate 13 in place, this lower region of the pool shell upright support combination becomes stiff. The brackets 7 and posts 9 can then be horizontally drilled and bolted to effect a connection at the upper end of the upright 9. In this way, the bracing structure is configured to take load as the loading system is unloading.

The lower upright 5, upright 9 and plate 13 together constitute an upright support. Preferably, the upright supports are spaced at centres in the range of 600 mm to 1,200 mm along the wall to be curved. Other forms of upright support are possible, e.g. upright 9 and plate 13 might be replaced by an integral component comprising corresponding upright and plate portions. The lower upright 5 is a convenient means of attaching the plate to the side wall of the shell, although other means of attachment are possible.

Preferably, once the bracing is made rigid to brace the side wall, the loading system 3 is unloaded. In the illustrated example, as the turnbuckles are relaxed, the inward curvature of the target walls is reduced to a non-zero inward curvature.

Preferably, the shell 1 is then filled with water (most preferably filled to about 200 mm below the top of the coping as would be typical in use). The initial applicant proposes a tolerance of +/−5 mm in the straightness of the side wall at this stage. If adjustment is called for, the bolt at a bracket 7-upright 9 interface can be removed and the side wall realigned (e.g. by reattaching one or more loading devices). The bolt-hole can then be redrilled and the bolt replaced. Additional fasteners may be placed to reinforce in the vicinity of the now-slotted bolt-hole, e.g. Tek screws may be used.

In this way, variations in the stiffness of the pool shell can be adjusted to produce a neat end product. Variations in stiffness can come about from, for example, variations in the density of the hand-applied rovings during the initial pool shell forming operation.

In a preferred method, the pool shell is labelled with a unique identifier and a photograph of the string line test is taken and permanently associated with the pool, e.g. associated in a database and/or documentation that may be delivered physically and/or electronically along with the pool. The present inventors have found that by maintaining straightness within a tolerance of +/−5 mm on their flat and level test slab, a pool delivered to a customer's site and installed on a concrete slab having more usual flatness tolerances usually has side edges within a tolerance of +/−10 mm.

The bracing structure comprising components 5, 7, 9, 11 and 13 is preferably predominantly plastic, e.g. GRP. Most preferably, each of components 5, 7, 9, 11 and 13 is formed of GRP. In a preferred version of the swimming pool unit, the only metallic components are the fasteners. This results in a dramatic weight advantage over various other options which is particularly advantageous in the context of prefabricated pool units. Not only does lower weight lead to lower road transport costs, but it can also lead to dramatically lower installation costs. In some installations, a crane is necessary to move the pool unit into position, e.g. the unit may need to be craned over a house. In the context of craning over a significant distance, weight reduction can lead to dramatic cost savings.

The uprights 9 may serve as convenient mounting points for attaching a decking adjacent to a pool. Alternatively, they may be covered over with cladding.

Prefabricated pool units may be supplied with cladding in place on one or more sides.

The invention is not limited to the examples discussed herein. Rather, the invention is defined by the claims.

The term "comprises" and its grammatical variants has a meaning that is determined by the context in which it appears. Accordingly, the term should not be interpreted exhaustively unless the context dictates so.

The invention claimed is:

1. A pool unit comprising:

a pool shell comprising a wall, wherein the pool shell is fillable with water; and bracing structure bracing the wall to curve inwardly with curvature that is selected such that the wall straightens to form a straight wall in response to the pool shell being filled with water.

2. The pool unit of claim 1 wherein the bracing structure comprises upright supports to act in compression between a rim of the pool shell and an underlying support surface.

3. The pool unit of claim 2 wherein each upright support comprises:

an upright strut portion; and an upright plate portion connecting the upright strut portion to the pool shell.

4. The pool unit of claim 3 wherein a height of the upright plate is at least one quarter of a height of the upright support.

5. The pool unit of claim 1 wherein the pool shell comprises a fiberglass pool shell.

6. A method, of forming a pool unit, comprising:

bracing a wall of a pool shell with a bracing structure to curve inwardly with curvature that is selected such that the wall straightens to form a straight wall in response to the pool shell being filled with water.

7. The method of claim 6 wherein the bracing comprises bracing while the pool shell is seated on a planar support surface comprising pavement.

8. The method of claim 6 comprising loading a loading system to inwardly curve the wall then bracing the wall with the bracing structure.

9. The method of claim 8 comprising unloading the loading system to load the bracing structure.

10. The method of claim 8 comprising unloading the loading system to load the bracing structure, then checking a straightness of the wall.

11. The method of claim 10 comprising adjusting the bracing of the wall in response to the checking.

12. The method of claim 8 comprising unloading the loading system to load the bracing structure; then at least partly filling the pool shell; then checking a straightness of the wall.

13. The method of claim 12 comprising adjusting the bracing of the wall in response to the checking.

14. The method of claim 6 comprising transporting the pool unit to a site then filling the pool shell to straighten the wall.

15. The method of claim 6 wherein the pool shell comprises a fiberglass pool shell.

* * * * *